US008145085B2

(12) United States Patent
Takahashi

(10) Patent No.: US 8,145,085 B2
(45) Date of Patent: Mar. 27, 2012

(54) IMAGE FORMING APPARATUS

(75) Inventor: Masamitsu Takahashi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 423 days.

(21) Appl. No.: 12/410,707

(22) Filed: Mar. 25, 2009

(65) Prior Publication Data

US 2009/0245834 A1 Oct. 1, 2009

(30) Foreign Application Priority Data

Mar. 28, 2008 (JP) ..... 2008-087237

(51) Int. Cl.
*G03G 15/16* (2006.01)

(52) U.S. Cl. ..... 399/66

(58) Field of Classification Search ..... 399/38, 399/66, 88, 89, 121, 297, 298
See application file for complete search history.

(56) References Cited

U.S. PATENT DOCUMENTS

| | | | | |
|---|---|---|---|---|
| 7,376,366 | B2 | 5/2008 | Deguchi | |
| 7,499,292 | B2 | 3/2009 | Inukai et al. | |
| 2006/0029410 | A1 * | 2/2006 | Deguchi | 399/66 |
| 2007/0008746 | A1 | 1/2007 | Inukai et al. | |
| 2008/0003003 | A1 * | 1/2008 | Watanabe et al. | 399/49 |
| 2008/0298091 | A1 | 12/2008 | Inukai | |
| 2009/0052923 | A1 | 2/2009 | Inukai | |

FOREIGN PATENT DOCUMENTS

| | | | |
|---|---|---|---|
| JP | 8-314295 | * | 11/1996 |
| JP | 2000-147923 | | 5/2000 |
| JP | 2002-082495 | | 3/2002 |
| JP | 2004-088965 | A | 3/2004 |
| JP | 2006-053175 | | 2/2006 |
| JP | 2007-020367 | A | 1/2007 |
| JP | 2008-299203 | A | 12/2008 |
| JP | 2009-048103 | A | 3/2009 |

OTHER PUBLICATIONS

JP Office Action dtd Nov. 5, 2009, JP Appln. 2008-087237, English translation.

* cited by examiner

*Primary Examiner* — Hoan Tran
(74) *Attorney, Agent, or Firm* — Banner & Witcoff, Ltd.

(57) ABSTRACT

The image forming apparatus includes a transfer device, an applying circuit, a computation circuit, and a controller. The applying circuit applies transfer bias voltage to the transfer device. The computation circuit derives relational expressions (a linear expression and a quadratic expression) according to control signal value calculating zones (a linear-expression and a quadratic-expression computing zones). Each relational expression shows relationship between the control signal value (PWM_Duty) for the applying circuit and the transfer current It generated by the transfer bias voltage. The control signal value calculating zones are divided by a preset control signal value (computation changing Duty). Then, the computation circuit calculates a target control signal value that corresponds to a target transfer current value using the derived expressions and according to the calculating zone.

12 Claims, 12 Drawing Sheets

FIG.11

Table LOAD AND SETTING OF COMPUTATION CHANGING Duty

| LOAD[MΩ] | 0～60 | 60～300 | 300～500 | 500～ |
|---|---|---|---|---|
| COMPUTATION CHANGING Duty[%] | 52 | 51 | 50 | 48 |

IMAGE FORMING APPARATUS

CROSS REFERENCE TO RELATED APPLICATION

This application claims priority from Japanese Patent Application No. 2008-087237 filed on Mar. 28, 2008. The entire content of this priority application is incorporated herein by reference.

TECHNICAL FIELD

The present invention relates to an image forming apparatus or, more specifically, control of a transfer bias voltage of the image forming apparatus.

BACKGROUND

It is a known art to calculate a PWM (Pulse Width Modulation) duty ratio (a control signal value) for setting a detected transfer current value at a target transfer current. In this art, the PWM duty ratio is calculated using a relational expression representing relationship between a PWM duty ratio at a time point for generating a required transfer bias voltage and the detected transfer current value that corresponds to the duty ratio at this time point, and thereby generates a given transfer bias voltage.

However, the relationship between the PWM duty ratio and the transfer current value is not necessarily constant over a whole control zone of the PWM duty ratio. Therefore, where it is attempted to calculate the target duty ratio using a single relational expression over the whole control zone of the PWM duty ratio, there is a concern of increasing an error between the calculated target duty value and an actual target duty ratio.

Thus, there is a need in the art for an image forming apparatus having improved accuracy in calculating a control signal value suitable for setting a transfer current at a target value.

SUMMARY

One aspect of the present invention includes an image forming apparatus having an image carrier configured to carry a developer image, a transfer device configured to transfer the developer image to recording media, an applying circuit configured to apply transfer bias voltage to the transfer device, a computation circuit, and a controller. The computation circuit derives a relational expression according to a control signal value calculating zone, representing relationship between a control signal value supplied to the applying circuit and a transfer current due to applying the transfer bias voltage. The computation circuit calculates a target control signal value according to the calculating zone and using the derived relational expression. The target control signal value corresponds to a target transfer current value. The controller controls the applying circuit using the control signal having the target control signal value.

In accordance with this aspect of the present invention, the control signal value for controlling the applying circuit is calculated using the expression suitable for the division of the control signal value. Therefore, the accuracy in calculating the target control signal value suitable for setting the transfer current at the target transfer current value.

BRIEF DESCRIPTION OF THE DRAWINGS

FIG. 11 is a table showing relationship between the load resistance and computation changing Duty.

DETAILED DESCRIPTION

<First Illustrative Aspect>

A first illustrative aspect of a laser printer (an illustration of an image forming apparatus) in accordance with the present invention will be described with reference to FIGS. 1 through 8.

1. Configuration of Laser Printer

Figure 1:
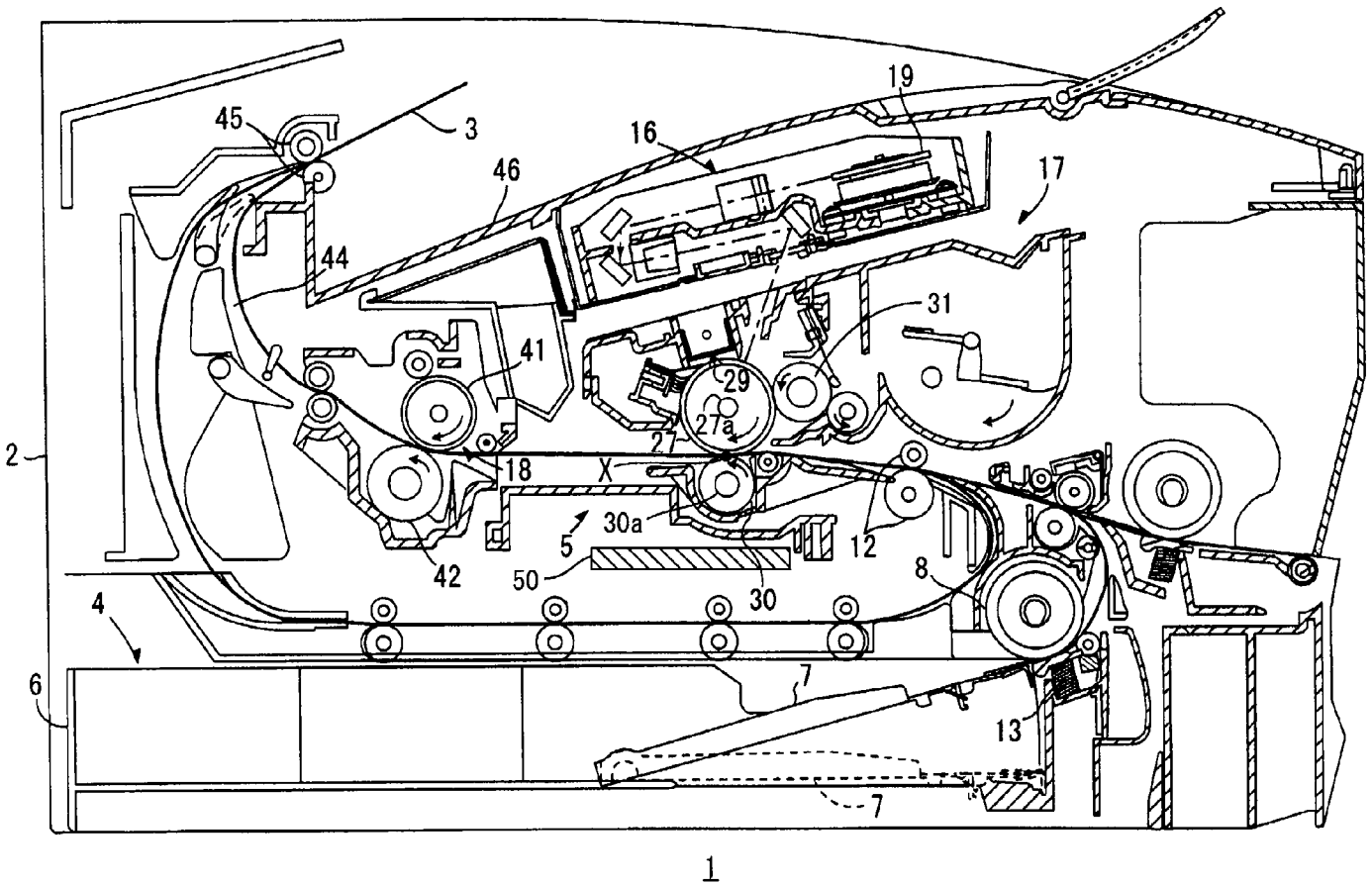
FIG. 1 is a side cross-sectional view of main parts of a laser printer of a first illustrative aspect in accordance with the present invention.

FIG. 1 is a side cross-sectional view of main parts of a laser printer 1 (that will be hereinafter referred to simply as the "printer"). Note that, hereinafter, the right side in FIG. 1 will represent the front side of the printer 1, while the left side in FIG. 1 will represent the rear side of the printer 1. In FIG. 1, the printer 1 includes a body frame 2, a sheet-feeding unit 4, an image forming mechanism 5, and the like. The sheet-feeding unit 4 and the image forming mechanism 5 are disposed in the body frame 2. The sheet-feeding unit 4 feeds each sheet 3 (an illustration of recording media, herein sheet is broadly defined as paper, plastic, and the like). The image forming mechanism 5 forms images on the fed sheet 3.

Note that the "image forming apparatus" may be a monochromatic printer or a two-color printer. Furthermore, the "image forming apparatus" is not limited to the laser printer; it may be also, for example, a LED printer or a multi-function machine having a facsimile function, a printer function, a read function (scanner function), and the like.

(1) Sheet-Feeding Unit

The sheet-feeding unit 4 includes a sheet-feed tray 6, a sheet-pressing plate 7, a sheet-feed roller 8, and a registration roller 12. The sheet-pressing plate 7 can pivot about a rear end portion thereof. The sheet 3 which is located at an uppermost position on the sheet-pressing plate 7 is pressed toward the sheet-feed roller 8. Then, the sheets 3 are fed one by one by rotation of the sheet-feed roller 8.

The fed sheet 3 is registered by the registration roller 12 and, thereafter, is sent to a transfer position X. Note that the transfer position X is a position where the toner image on a photosensitive drum 27 is transferred to the sheet 3. The transfer position X is a contact position of the photosensitive drum 27 (an illustration of an image carrier) with the transfer roller 30 (an illustration of a transfer device).

(2) Image Forming Mechanism

The image forming mechanism 5 includes, for example, a scanner 16, a process cartridge 17, and a fuser 18.

The scanner 16 includes a laser emitter (not illustrated), a polygon mirror 19, and the like. Laser beam (shown by dashed-dotted line in the figure) emitted from the laser emitter is deflected by the polygon mirror 19 and exposes a surface of the photosensitive drum 27.

The process cartridge 17 includes a developing roller 31, the photosensitive drum 27, a scorotron charger 29, and a transfer roller 30. Note that a drum shaft 27*a* of the photosensitive drum 27 is grounded.

The charger 20 uniformly and positively charges the surface of the photosensitive drum 27. Thereafter, the surface of the photosensitive drum 27 is exposed to the laser beam emitted from the scanner 16, whereby an electrostatic latent image is formed. Next, toner carried on a surface of the developing roller 31 is supplied to the electrostatic latent image formed on the photosensitive drum 27, whereby the electrostatic latent image is developed.

The transfer roller 30 includes a metal roller shaft 30*a*. Connected to the roller shaft 30*a* is an applying circuit 60 (an illustration of an applying circuit) (see FIG. 2). The applying circuit 60 is mounted on a substrate 50. At a time of transfer operation, a transfer bias voltage Va is applied from the applying circuit 60.

As the sheet 3 passes between a heat roller 41 and a pressure roller 42, the fuser 18 fuses the toner on the sheet 3. The sheet 3 after the fusing process is released through a sheet exit path 44 onto a sheet exit tray 46.

(Configuration of Transfer Bias Voltage Generation Circuit)

Figure 2:
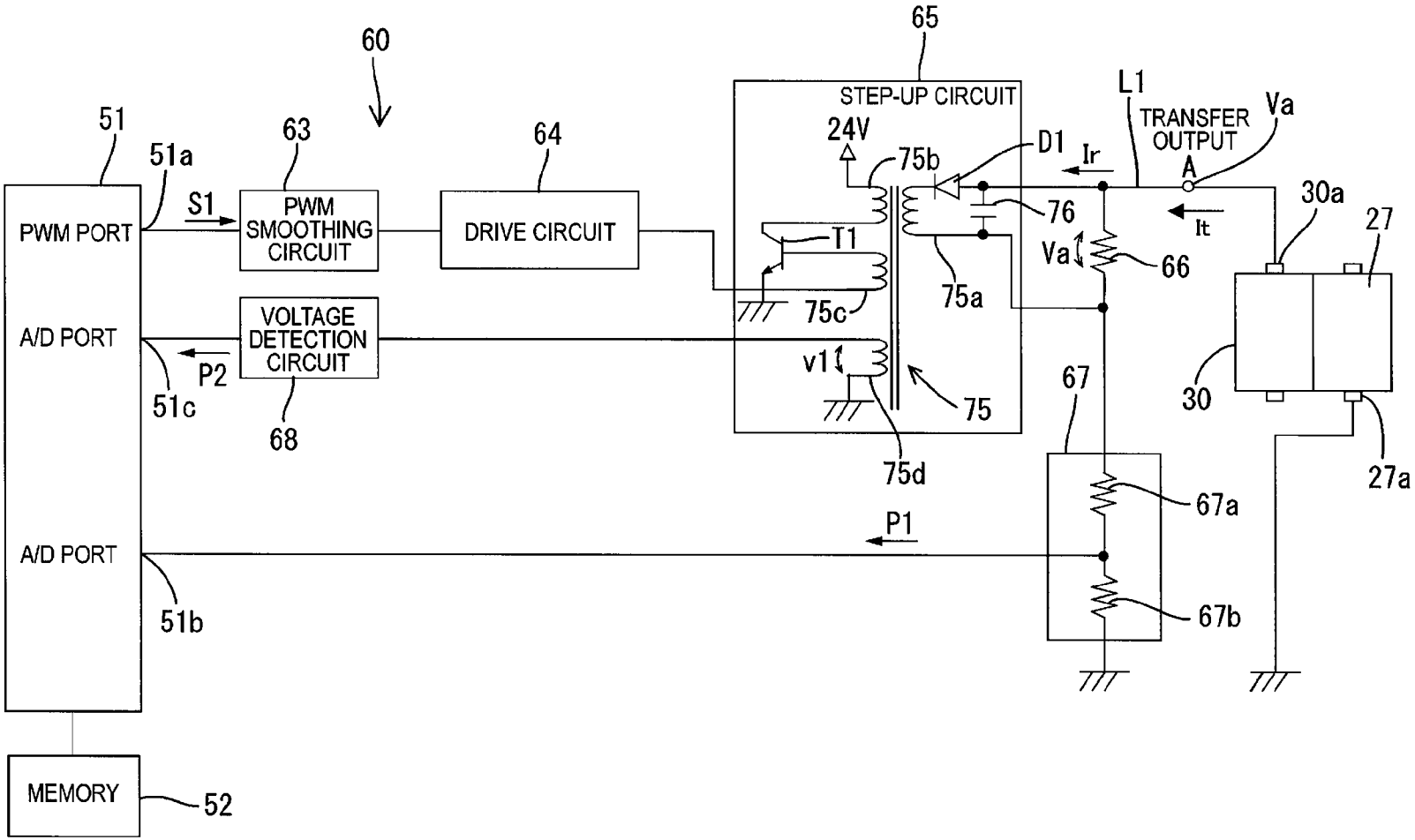
FIG. 2 is a block diagram showing configurations of main parts of an applying circuit for generating transfer bias voltage.

FIG. 2 shows configurations of main parts of the applying circuit 60, a control circuit 51 (an illustration of a controller, a computation circuit, and a resistance detecting circuit), and a memory 52. The applying circuit 60 applies the transfer bias voltage Va to the transfer roller 30. Programs and the like, which can be executed by the control circuit 51, are stored in the memory 52.

The applying circuit 60 includes a PWM smoothing circuit 63, a drive circuit 64, a step-up circuit 65, a current detection circuit 67 (an illustration of a current detecting circuit and the resistance detecting circuit), a voltage detection circuit 68, and the like.

The PWM smoothing circuit 63 has, for example, a resistor and a capacitor (not illustrated). The PWM smoothing circuit 63 receives a PWM (Pulse Width Modulation) signal S1 (an illustration of a control signal) from a PWM port 51*a* of the control circuit 51, smoothes the PWM signal, and supplies the smoothed PWM signal S1 to the drive circuit 64.

A predetermined DC voltage, e.g. DC voltage of 3 V, is applied to the drive circuit 64. The drive circuit 64 is connected through a self-excited winding 75*c* of the step-up circuit 65 to a base of a transistor T1.

The drive circuit 64 is configured to supply oscillation current to a primary winding 75*b* of the step-up circuit 65 based on the smoothed PWM signal S1 supplied from the PWM smoothing circuit 63. Furthermore, in this illustrative aspect, the drive circuit 64 is configured as follows: when a value of the smoothed PWM signal S1 supplied from the PWM smoothing circuit 63 is decreased, the base current flowing through the transistor T1 of the step-up circuit 65 is increased; further, when the value of the smoothed PWM signal S1 is decreased to a predetermined value or less, the rate of increase of the base current is enlarged (see FIG. 3).

Accordingly, the drive circuit 64 of this illustrative aspect is configured such that, as the duty ratio (an illustration of a control signal value) of the PWM signal is increased, the transfer bias voltage Va generated by the step-up circuit 65 is decreased and a transfer current It is also decreased. That is, in the applying circuit 60 of this illustrative aspect, as the duty ratio is decreased from 100% to 0%, the transfer current It is increased (see FIG. 3).

The step-up circuit 65 includes a transformer 75, a diode D1, and a smoothing capacitor 76, and the like. The transformer 75 has a secondary winding 75*a*, the primary winding 75*b*, the self-excited winding 75*c*, and an auxiliary winding 75*d*. An end of the secondary winding 75*a* is connected through the diode D1 and a connecting line L1 to the roller shaft 30*a* of the transfer roller 30. The other end of the secondary winding 75*a* is grounded through the current detection circuit 67. The smoothing capacitor 76 and a discharge resistor 66 are connected in parallel with each other to the secondary winding 75*a*.

Thus, the oscillation current in the primary winding 75*b* is stepped up and rectified in the step-up circuit 65, and is applied as the transfer bias voltage (for example, negative high voltage) Va to the roller shaft 30*a* of the transfer roller 30. The transfer current It flowing through the transfer roller 30 (taking a value of current that flows in the direction of an arrow in FIG. 2) flows into resistors 67*a*, 67*b* of the current detection circuit 67, and a detection signal P1, which depends on the transfer current It, is fed back to an A/D port 51*b* of the control circuit 51.

At the time of transfer operation, the sheet 3 reaches the above-described transfer position X, and the toner image on the photosensitive drum 27 is transferred to the sheet 3. At this time, the control circuit 51 supplies the PWM signal S1 to the PWM smoothing circuit 63. This causes the transfer bias voltage Va to be applied to the roller shaft 30*a* of the transfer roller 30, which is connected to an output end A of the step-up circuit 65. Along with this, the control circuit 51 executes constant current control based on the detection signal P1, which depends on a current value of the transfer current It flowing through the connecting line L1. With the constant current control, the duty ratio of the PWM signal S1 outputted to the PWM smoothing circuit 63 is properly modulated so that the current value of the transfer current It is within a target range.

(3) Configuration for Measuring Load Resistance

Next, a configuration for calculating load resistance R in the power supply path for supplying power to the transfer roller 30 will be described. The power supply path is the path that runs from the above-described output end A, through the transfer roller 30 and the photosensitive drum 27, and is grounded.

As shown in FIG. 2, the voltage detection circuit 68 of the applying circuit 60 is connected between the auxiliary winding 75*d* of the transformer 75 of the step-up circuit 65 and the control circuit 51. The voltage detection circuit 68 has, for example, a diode and a resistor (not illustrated). At a the time of transfer operation performed by the applying circuit 60, the voltage detection circuit 68 detects an output voltage v1 generated between the auxiliary winding 75*d*, and supplies a detection signal P2 to an A/D port 51*c*.

The control circuit 51 loads the detection signals P1, P2 and calculates the present load resistance R of the transfer roller 30 from a current value of the transfer current It and a voltage value of the output voltage v1. Here, the transfer bias voltage Va can be estimated from relationship between the voltage value of the output voltage v1 and the number of turns of the secondary winding 75*a*, the primary winding 75*b*, and the auxiliary winding 75*d*. Then, the load resistance R can be calculated from formula 1, which is as follows (concerning the estimated transfer bias voltage Va).

$$Va = (\text{the resistor } 67a + \text{the resistor } 67b + \text{the load resistance } R) * It \qquad \text{Formula 1}$$

Here, because Va, the resistance (67*a*+67*b*), and It has been determined, the load resistance R is calculated from the formula 1. Note that, here, the load resistance R includes resistance of the transfer roller 30 and the photosensitive drum 27.

2. Process of Calculating Duty Ratio of PWM Signal

Figure 3:
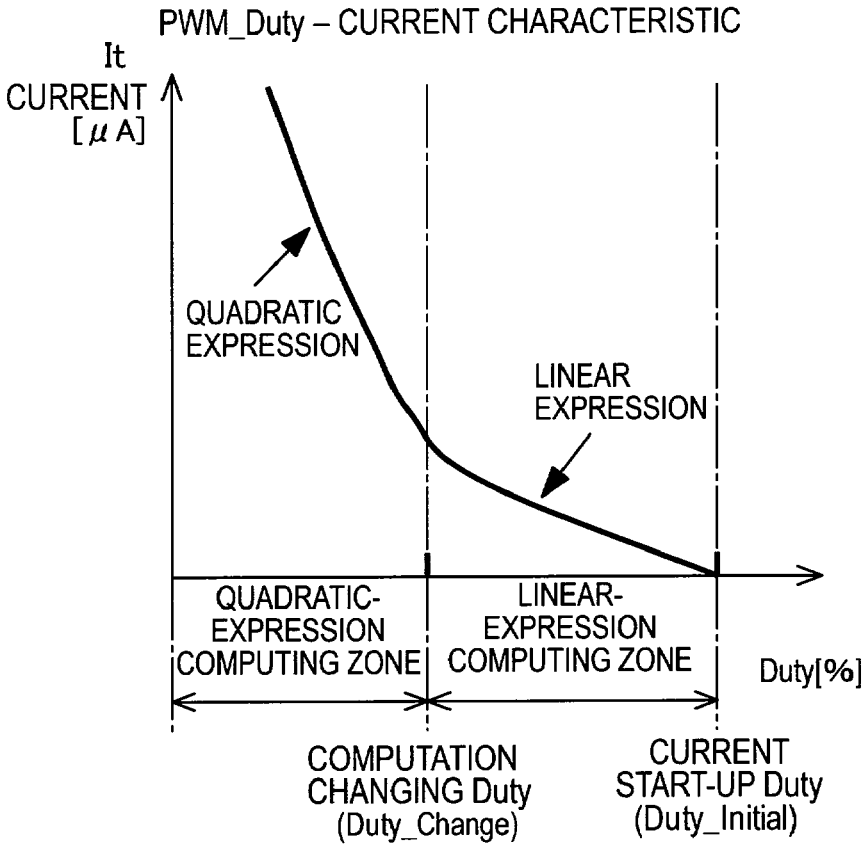
FIG. 3 is a graph showing relationship between a duty ratio of a PWM signal and a transfer current.

Next, process of calculating the duty ratio of the PWM signal 1 of the first illustrative aspect will be described with reference to FIGS. 3 through 8. FIG. 3 is a graph showing relationship between the duty ratio of the PWM signal S1 (hereinafter referred to simply as the "duty ratio") [%] and the transfer current It [μA] In this illustrative aspect, as described above, the circuit configurations of the applying circuit 60 is configured such that the transfer current is increased as the duty ratio is decreased.

In the first illustrative aspect, the control circuit 51 derives linear expressions and quadratic expressions (relational expressions) that represent relationship between the duty ratio (Duty) and the transfer current It according to duty ratio calculating zones. Here, the calculating zones are divided by a computation changing duty ratio (Duty_Change) into a linear-expression computing zone (an illustration of a "first calculating zone") and a quadratic-expression computing zone (an illustration of a "second calculating zone"), as shown in FIG. 3. Then, the control circuit 51 calculates a target duty ratio (a target control signal value) that corresponds to a target transfer current value using the derived linear expression and quadratic expression according to the calculating zones.

Here, in a case where an arbitrary duty ratio (corresponding to an "arbitrary control signal value") for deriving the above relational expressions belongs to the linear-expression computing zone, the control circuit 51 derives the linear expression (an illustration of a "first relational expression"). On the other hand, in a case where the arbitrary duty ratio belongs to the quadratic-expression computing zone, the control circuit 51 derives the quadratic expression (an illustration of a "second relational expression").

Note that, in this illustrative aspect, the computation changing duty ratio (corresponding to a "preset control signal value") is a fixed value that is arbitrarily determined in advance by experiments or the like and is stored as a data in, for example, the memory 52.

Furthermore, in FIG. 3, a current start-up duty ratio (Duty_Initial) is a duty ratio that can start up the transfer current It, i.e. the duty ratio of the point where the duty ratio gradually decreased from 100% causes the transfer current It to start to flow. The current start-up duty ratio is determined in advance by experiments or the like and is stored as a data in the memory 52. The current start-up duty ratio corresponds to a "predetermined control signal value". Furthermore, the value of the transfer current It corresponding to the current start-up duty ratio (corresponding to a "predetermined transfer current value") is set at "zero" in this illustrative aspect.

Figure 4:
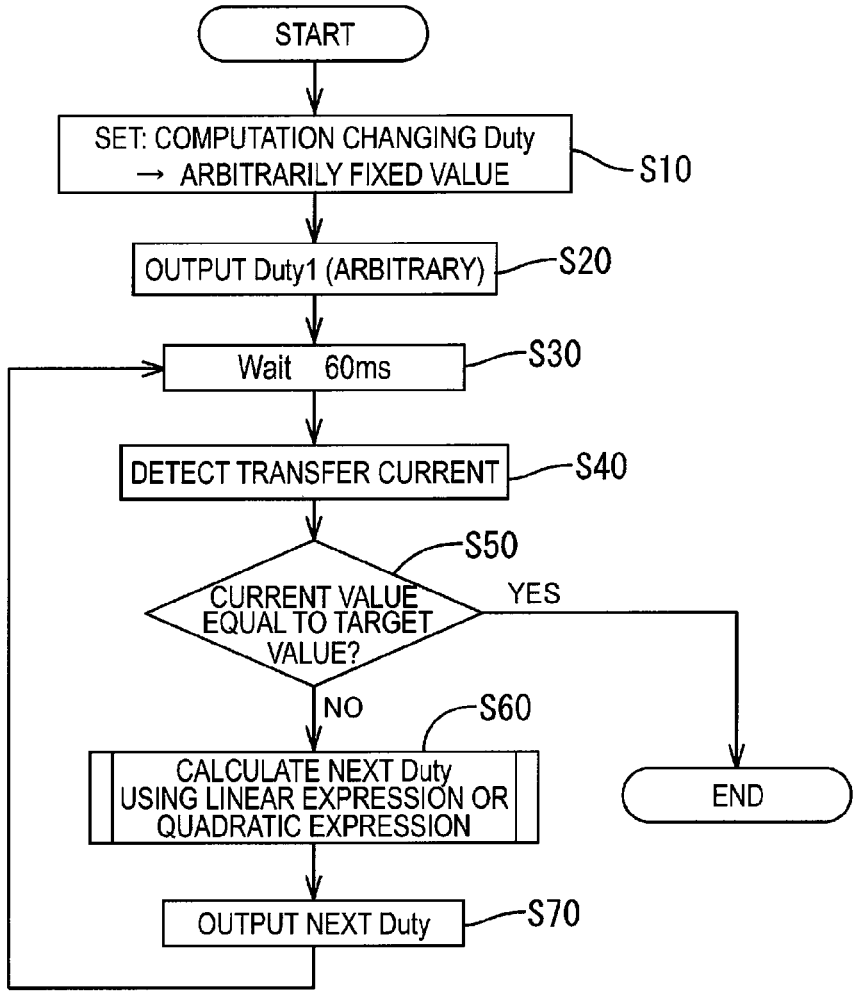
FIG. 4 is a flowchart showing each processing of calculating the duty ratio performed in the first illustrative aspect.

FIG. 4 is a flowchart showing each processing of calculating the duty ratio in the first illustrative aspect. Each processing is executed by the control circuit 51 according to a processing program stored in the memory 52. At the time of transfer operation where, as above described, the sheet 3 reaches the transfer position X and the toner image on the photosensitive drum 27 is transferred to the sheet 3, the control circuit 51 executes each processing in order to supply the PWM signal S1 to the PWM smoothing circuit 63.

Now, in step S10 shown in FIG. 4, the control circuit 51 sets the operation changing duty ratio at the arbitrarily fixed value, as described above. Next, in step S20, the control circuit 51 outputs the arbitrary duty ratio (corresponding to the "arbitrary control signal value") (Duty1) as the duty ratio to the PWM smoothing circuit 63 of the applying circuit 60. Then, in step S30, the control circuit 51 waits for a predetermined time, e.g. for 60 ms. This waiting processing is performed in order to wait for the operation of the applying circuit 60 based on the arbitrary duty ratio to be stabilized.

Note that, in a case where overshooting of the transfer current It should be avoided, it is preferable to set the arbitrary duty ratio (Duty1) at a value that belongs to the linear-expression computing zone. The reason of this is that, in this case, the transfer current value It that corresponds to the arbitrary duty ratio tends to be lower than a transfer current value It that corresponds to an arbitrary duty ratio having the value belonging to the second calculating zone.

On the other hand, in a case where it is desired to calculate the target duty ratio still accurately and promptly, it is preferable to set the arbitrary duty ratio at a value that belongs to the quadratic-expression computing zone. In this case, the transfer current value It that corresponds to this arbitrary duty ratio tends to be higher than a transfer current value that corresponds to an arbitrary duty ratio having the value belonging to the first calculating zone, and therefore, the target duty ratio enough to high for generating the target transfer current (I_Target) is easy to promptly calculate. Furthermore, because the transfer current value It (in a case of greater load resistance R) is lower than the transfer current value It in a case of less load resistance R at a same duty ratio, it is preferable in the case of greater load resistance R.

In addition, the arbitrary duty ratio (Duty1) is preferably a duty ratio that is approximate to the target duty ratio. In this case, a plurality of duty ratios each according to, for example, respective circumstances where the transfer bias voltage is applied, are determined as the arbitrary duty ratio in advance by experiments or the like, and are stored in the memory 52. Then, the control circuit 51 selects, out of the plurality of duty ratios, an arbitrary duty ratio that is suitable for the circumstance where the transfer bias voltage is applied.

Next, in step S40, the control circuit 51 detects the present transfer current Ii. Note that the present transfer current Ii depends on the load resistance R and the transfer bias voltage Va, which is generated by the applying circuit 60 and based on the arbitrary duty ratio (Duty1). Specifically, the control circuit 51 receives the detection signal P1 through the current detection circuit 67 and the A/D port 51*b*. The detection signal P1 depends on the present transfer current Ii, and therefore, the transfer current Ii at the time point is detected based on the detection signal P1.

Then, it is determined in step S50 whether or not the detected present transfer current Ii is equal to the target transfer current value (I_Target). When it is determined that the present transfer current Ii is equal to the target transfer current value (I_Target), the present process is terminated for a while.

On the other hand, when it is determined in the step S50 that the present transfer current Ii is not equal to the target transfer current value (I_Target), the process goes to step S60. In the step S60, the control circuit 51 executes a "next Duty calculating using linear expression or quadratic expression" routine, which will be described below. Then, in step S70, a next duty ratio (Duty_Next) calculated in the step S60 is outputted to the PWM smoothing circuit 63 of the applying circuit 60. Then, the control circuit 51 repeats the processing of the steps from S30 to S70 until the present transfer current Ii becomes equal to the target transfer current value (I_Target).

Figure 5:
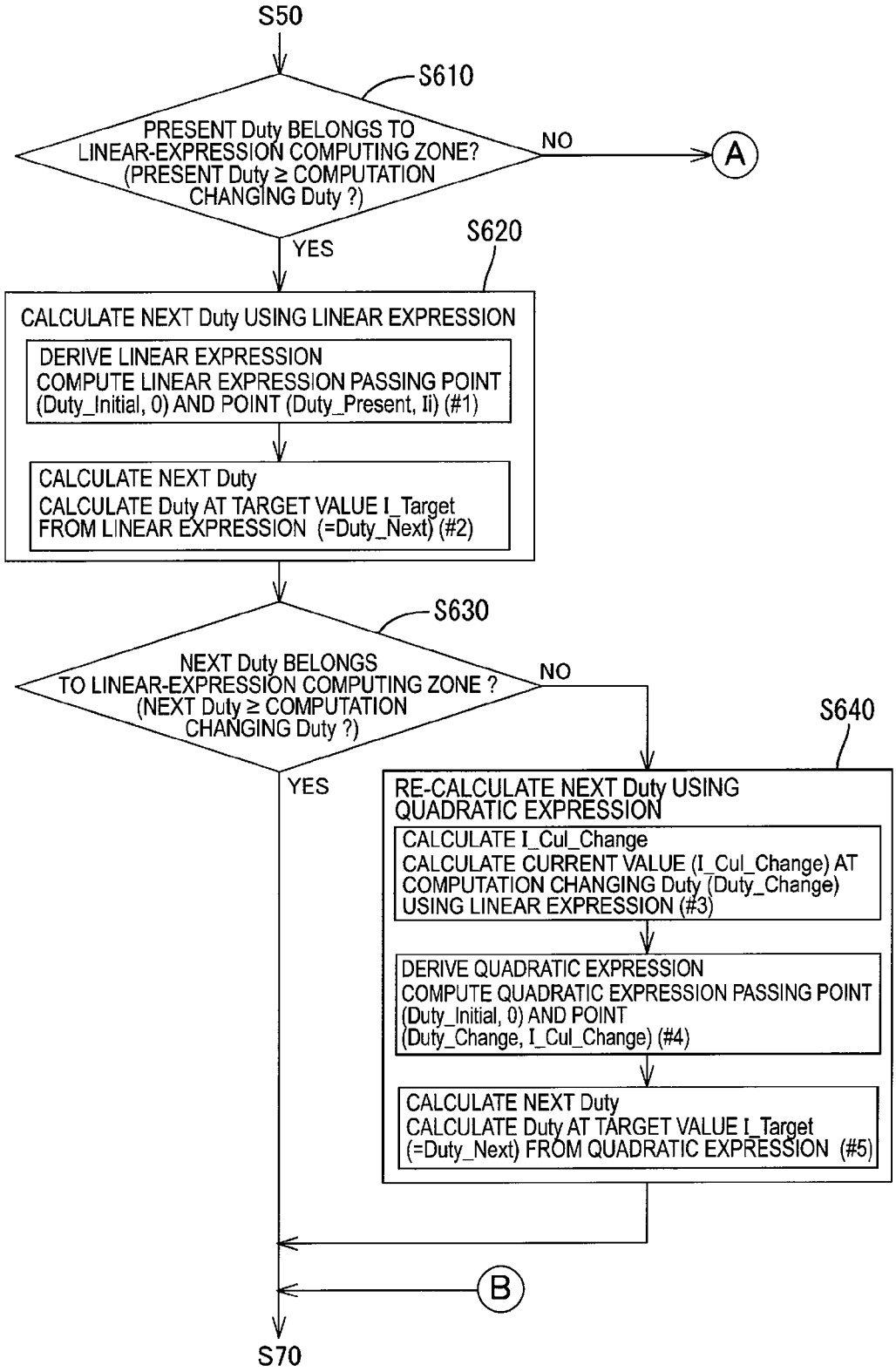
FIG. 5 is a partial flowchart of a routine for calculating a next Duty using a linear expression or a quadratic expression.
Figure 6:
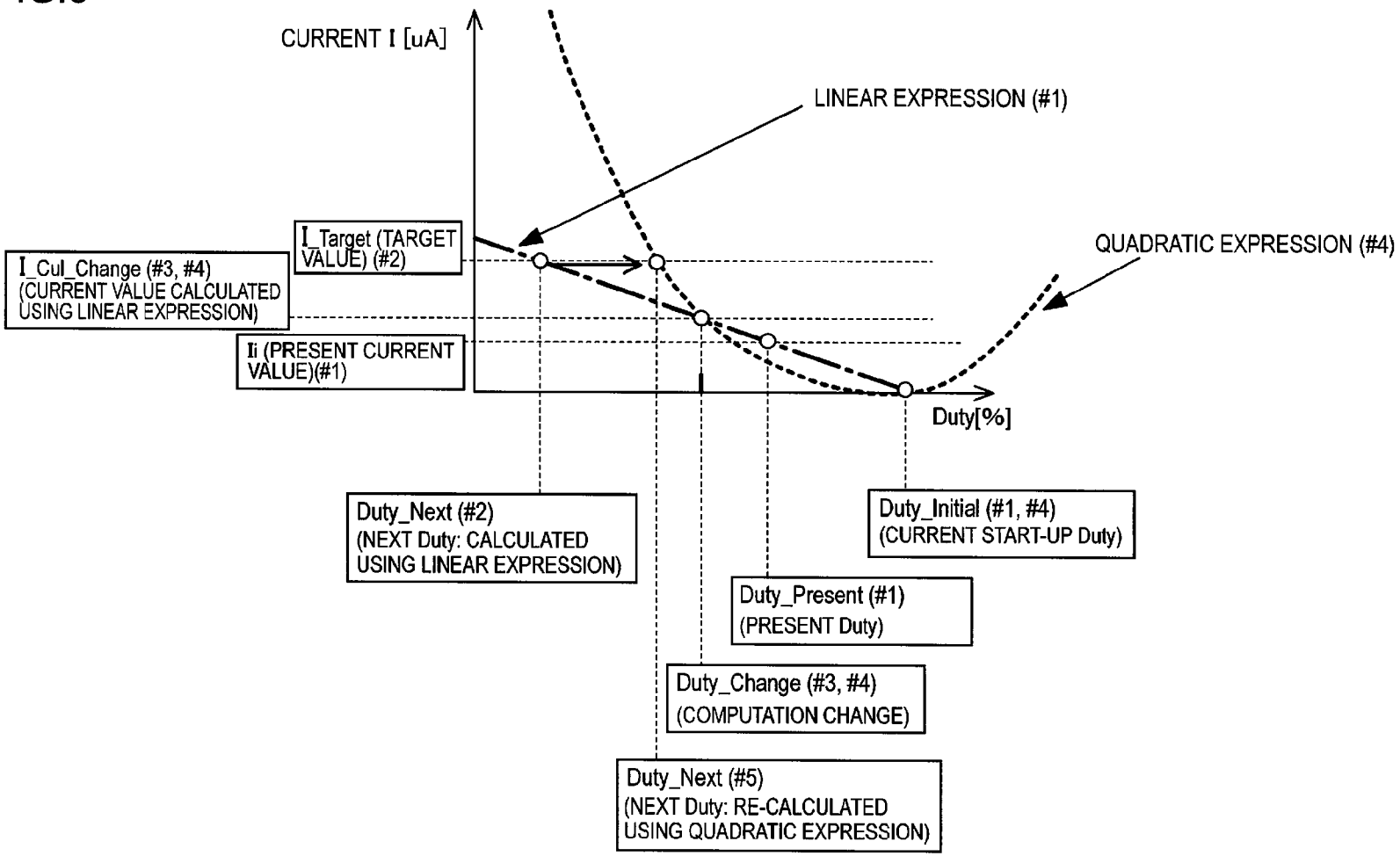
FIG. 6 is a graph explaining the processing shown in FIG. 5.
Figure 7:
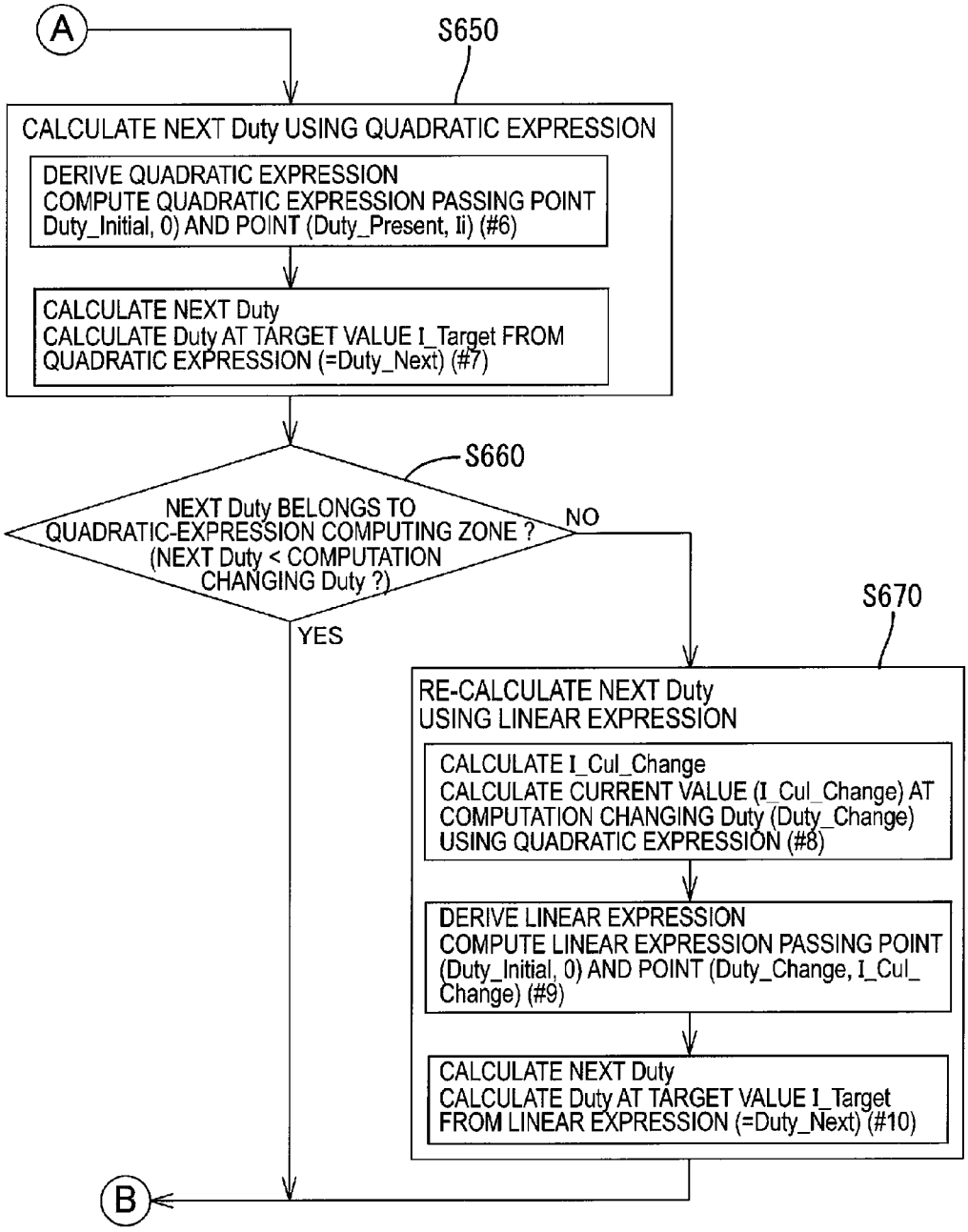
FIG. 7 shows a partial flowchart of the routine for calculating the next Duty using the linear expression or the quadratic expression.
Figure 8:
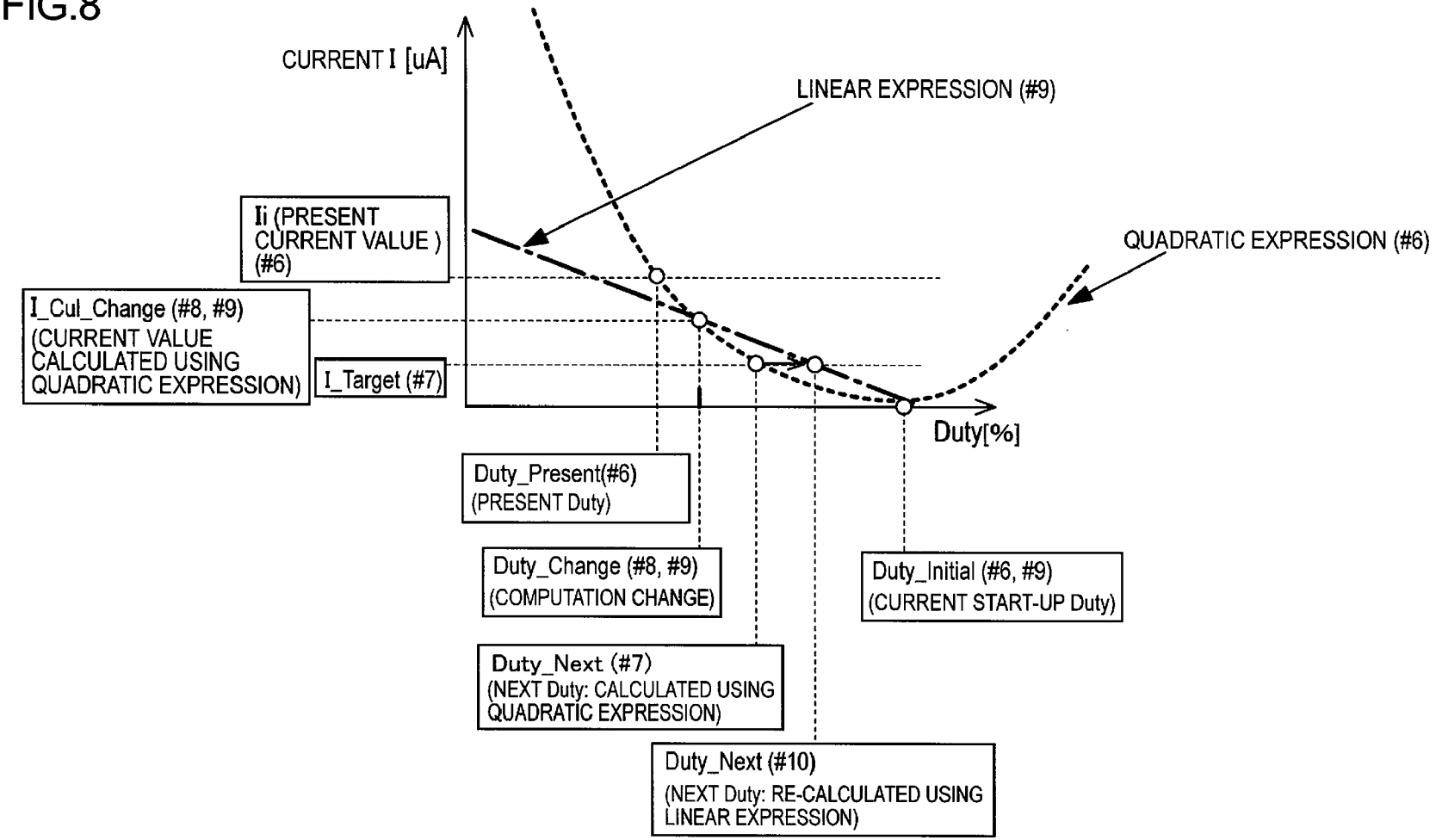
FIG. 8 is a graph explaining the processing shown in FIG. 7.

2-1. "Next Duty Calculating Using Linear Expression or Quadratic Expression" Routine Next, the "next Duty calculating using linear expression or quadratic expression" routine, which is the processing of the step S60, will be described with reference to FIGS. 5 through 8. FIG. 5 shows a part of the processing of this routine; FIG. 6 is a graph expressing the processing shown in FIG. 5. FIG. 7 shows the rest part of the same routine; FIG. 8 is a graph expressing the processing shown in FIG. 7.

First, in step S610 shown in FIG. 5, the control circuit 51 determines whether or not the present duty ratio (Duty_Present) belongs to the linear-expression computing zone shown in FIG. 3, i.e. whether or not the present duty ratio is equal to or greater than the computation changing duty ratio. When the present duty ratio belongs to the linear-expression computing zone, the process goes to step S620. In the step S620, the next duty ratio (Duty_Next) is calculated using a linear expression. On the other hand, when the present duty ratio does not belong to the linear-expression computing zone, the process goes to step S650 (see FIG. 7). In the step S650, the next duty ratio is calculated using a quadratic expression.

As shown in FIG. 6, in the processing of the step S620, the control circuit 51 first computes, and derives, a linear expression that passes a point (Duty_Initial, 0) (an illustration of "first coordinates") and a point (Duty_Present, Ii) (an illustration of "second coordinates") (#1). Next, the target duty ratio (corresponding to the "target control signal value") at the target transfer current value (I_Target) is calculated from the derived linear expression, and the target duty ratio is set as the next duty ratio (Duty_Next) (#2).

Next, in step S630, the control circuit 51 determines whether or not the next duty ratio (Duty_Next) belongs to the linear-expression computing zone, i.e. whether or not the next duty ratio is equal to or greater than the computation changing duty ratio. When the next duty ratio belongs to the linear-expression computing zone, the process goes to the step S70 shown in FIG. 4. In the step S70, the calculated next duty ratio is outputted to the PWM smoothing circuit 63 of the applying circuit 60. On the other hand, when the next duty ratio does not belong to the linear-expression computing zone (see FIG. 6), the process goes to step S640. In the step S640, the next duty ratio is re-calculated, using a quadratic expression.

In the processing of step S640, the control circuit 51 first calculates a transfer current value (I_Cul_Change) at the computation changing duty ratio (Duty_Change) using the derived linear expression (#3). Next, as shown in FIG. 6, the control circuit 51 computes, and derives, the quadratic (curved) expression that passes the point (Duty_Initial, 0) (the illustration of the "first coordinates") and the point (Duty_Change, I_Cul_Change) (an illustration of "third coordinates") (#4).

Next, a duty ratio at the target transfer current value (I_Target) is calculated from the derived quadratic expression, and this duty ratio is determined as the next duty ratio (Duty_Next) (#5). Then, the process goes to the step S70, so that the calculated next duty ratio is outputted to the PWM smoothing circuit 63 of the applying circuit 60.

On the other hand, as described above, when it is determined that the present duty ratio (Duty_Present) does not belong to the linear-expression computing zone, the process goes to the step S650 shown in FIG. 7 to calculate the next duty ratio (Duty_Next) using quadratic expression.

As shown in FIG. 8, in the processing of the step S650, the control circuit 51 first calculates, and derives, a quadratic (curved) expression that passes the point (Duty_Initial, 0) (an illustration of the "first coordinates") and the point (Duty_Present, Ii) (an illustration of the "second coordinates") (#6). Next, a duty ratio at the target transfer current value (I_Target) is calculated, and the duty ratio is set as the next duty ratio (Duty_Next) (#7).

Next, in step S660, the control circuit 51 determines whether or not the next duty ratio (Duty_Next) belongs to the quadratic-expression computing zone, i.e. whether or not the next duty ratio is less than the computation changing duty ratio. When the next duty ratio belongs to the quadratic-expression computing zone, the process goes to the step S70 shown in FIG. 4, so that the calculated next duty ratio is outputted to the PWM smoothing circuit 63 of the applying circuit 60. On the other hand, when the calculated next duty ratio does not belong to the quadratic-expression computing zone (see FIG. 8), the process goes to step S670 to re-calculate the next duty ratio, using a linear expression.

In the processing of the step S670, the control circuit 51 first calculates a transfer current value (I_Cul_Change) at the computation changing duty ratio (Duty_Change) using the derived quadratic expression (#8). Next, as shown in FIG. 8, the control circuit 51 computes, and derives, the linear (straight) expression that passes the point (Duty_Initial, 0) (an illustration of the "first coordinates") and the point (Duty_Change, I_Cul_Change) (an illustration of the "third coordinate") (#9).

Next, a target duty ratio (the target control signal value) at the target transfer current value (I_Target) is calculated using the derived linear expression, and the target duty ratio is set as the next duty ratio (Duty_Next) (#10). Then, the process goes to the step S70 shown in FIG. 4, so that the calculated next duty ratio is outputted to the PWM smoothing circuit 63 of the applying circuit 60.

As described above, in the first illustrative aspect, the control circuit 51 (the computation circuit) derives the linear expression or the quadratic expression (the relational expression) that represents the relationship between the duty ratio of the PWM signal S1 and the transfer current It according to the linear-expression computing zone or the quadratic-expression computing zone of duty ratio (the control signal value calculating zone). Then, the control circuit 51 calculates the target duty ratio (the target control signal value) that corresponds to the target transfer current value (I_Target) using the derived linear expression, or quadratic expression and according to the linear-expression computing zone or the quadratic-expression computing zone.

That is, the control circuit 51 calculates duty ratio using the relational expression according to the zone of the duty ratio. Therefore, accuracy in calculating the target duty ratio that is proper for setting the target transfer current value It can be improved.

Furthermore, the calculating zone for calculating the relational expression (the linear expression or the quadratic expression), which represents the relationship between the duty ratio and the transfer current It, is divided by the preset computation changing duty ratio (the preset control signal value) into the linear-expression computing zone and the quadratic-expression computing zone (the first calculating zone and the second calculating zone). Then, when the arbitrary duty ratio (the arbitrary control signal value) for deriving the relational expression belongs to the linear-expression computing zone, the control circuit 51 derives the linear expression (the first relational expression). On the other hand, when the arbitrary duty ratio belongs to the quadratic expression computing zone, the control circuit 51 derives the quadratic expression (the second relational expression). Therefore, the relationship between the duty ratio and the transfer current It can be approximated to the different relational expressions, with setting the preset computation changing duty ratio as the boundary. As a result of this, still more exact approximation can be realized. This illustrative aspect is a desired one specifically in a case where the relationship between the transfer current It and the duty ratio (the control signal value) accompanied with increase of the transfer current It can be approximated first to linear expression and thereafter to the quadratic expression.

Furthermore, in a case where either one of the duty ratio (the target control signal value), which is calculated using either one of the linear expression and the quadratic expression, and the arbitrary duty ratio (the arbitrary control signal value) is greater than the computation changing duty ratio (the preset control signal value), while the other one is less than the computation changing duty ratio, the control circuit 51 (the computation circuit) further derives the other expression (the other relational expression) which has not been used for calculating the duty ratio, using the point (Duty_Initial, 0) (the first coordinate) and the point (Duty_Change, I_Cul_Change) (the third coordinates). Then, the control circuit 51 assigns the target transfer current value to the further derived expression, and thereby re-calculates the target duty ratio (the target control signal value).

Therefore, by re-calculating the target duty ratio, increase of the error of the calculated target duty ratio can be prevented.

<Second Illustrative Aspect>

Next, a second illustrative aspect of the printer (an illustration of the image forming apparatus) in accordance with the present invention will be described with reference to FIGS. 9 through 11. Note that the second illustrative aspect is different in the "process of calculating the duty ratio of the PWM signal" from the first illustrative aspect, while the other configurations are identical with the first illustrative aspect. Therefore, described in this illustrative aspect will only be regarding the "control of calculation of the duty ratio of the PWM signal". In the "control of calculation of the duty ratio of the PWM signal", the processing identical with those of the first illustrative aspect will be designated with the identical step numbers, while the description will be omitted.

Figure 9:
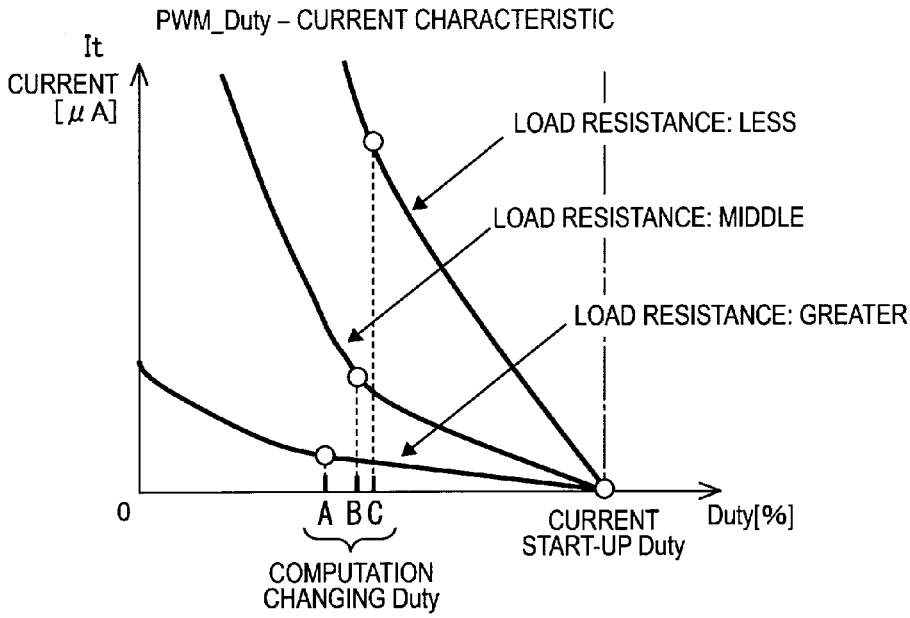
FIG. 9 is a graph showing relationship between the duty ratio and the transfer current with various load resistance.

FIG. 9 is a graph showing a relationship between the duty ratio of the PWM signal S1 and the transfer current It with various load resistance R. Usually, as shown in FIG. 9, the relationship between the duty ratio and the transfer current It varies according to the greatness of the above load resistance R. That is, as the load resistance R against an identical duty ratio is smaller, the transfer current It is greater. Likewise, the suitable computation changing duty ratio (Duty_Change) is also changed according to the load resistance R, as shown by reference symbols "A", "B", and "C" in FIG. 9. Therefore, in the second illustrative aspect, when calculating the duty ratio, the setting of the computation changing duty ratio is changed according to the load resistance R.

Figure 10:
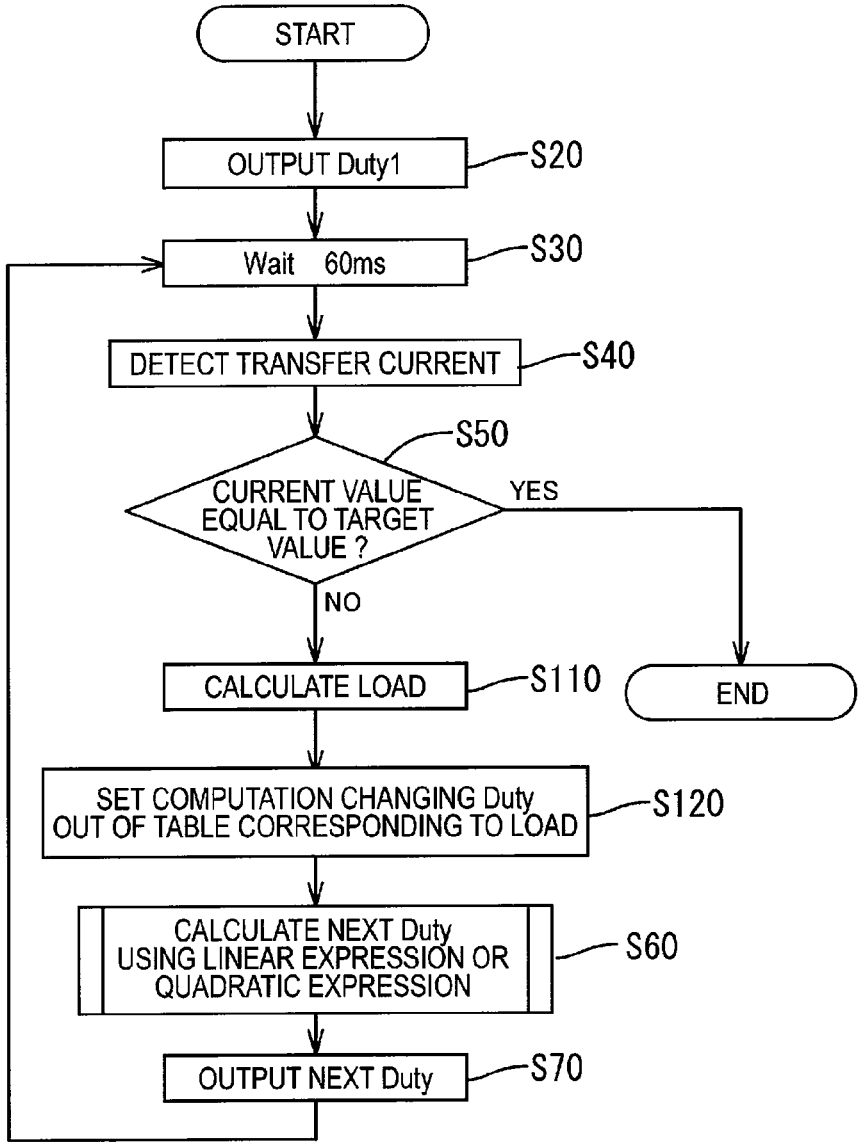
FIG. 10 is a flowchart showing each processing of calculating the duty ratio performed in a second illustrative aspect.

FIG. 10 is a flowchart showing each processing of calculating the duty ratio in the second illustrative aspect. When it is determined in the step S50 shown in FIG. 10 that the present transfer current Ii is not equal to the target transfer current value (I_Target), then, in step S110, the control circuit 51 calculates the load resistance R based on the above formula 1. Then, in step S120, the control circuit 51 sets the computation changing duty ratio based on a table showing the relationship between the load resistance R and the computation changing duty ratio. The table is illustrated in FIG. 11.

Next, the process goes to the step S60, so that the above described "next Duty calculating using linear expression or quadratic expression" routine is executed. Then, in the step S70, the next duty ratio (Duty_Next) calculated in the step S60 is outputted to the PWM smoothing circuit 63 of the applying circuit 60. Then, the control circuit 51 repeats the processing of the steps from S30 to S70 shown in FIG. 10 until the present transfer current Ii becomes equal to the target transfer current value (I_Target).

Thus, in the second illustrative aspect, when calculating the duty ratio (the target control signal value) at the target transfer current value, the setting of the computation changing duty ratio (the preset control signal value) is changed according to the load resistance R. Therefore, accuracy in calculating the duty ratio can be improved.

<Third Illustrative Aspect>

Next, a third illustrative aspect of the printer (an illustration of the image forming apparatus) in accordance with the present invention will be described with reference to FIGS. 9 and 12. Note that, as in the second illustrative aspect, the third illustrative aspect is different in the "process of calculating the duty ratio of the PWM signal" from the first illustrative aspect. Therefore, described in this illustrative aspect will be only about the "control of calculation of the duty ratio of the PWM signal". In the "control of calculation of the duty ratio of the PWM signal", the processing identical with those of the first illustrative aspect will be designated with the identical step numbers, while the description will be omitted.

As described above, the relationship between the duty ratio of the PWM signal and the transfer current It is various according to the greatness of the above described load resistance R. Furthermore, as shown in FIG. 9, the change amount of the transfer current It at an identical change amount of the duty ratio is also various. That is, as the load resistance R is smaller, the change amount of the transfer current It at the identical change amount of the duty ratio is greater, and the proper approximate expression is also various according to the greatness of the load resistance R. Therefore, in the third illustrative aspect, when calculating the duty ratio, the approximate expression to be used is changed according to the load resistance R.

Figure 12:
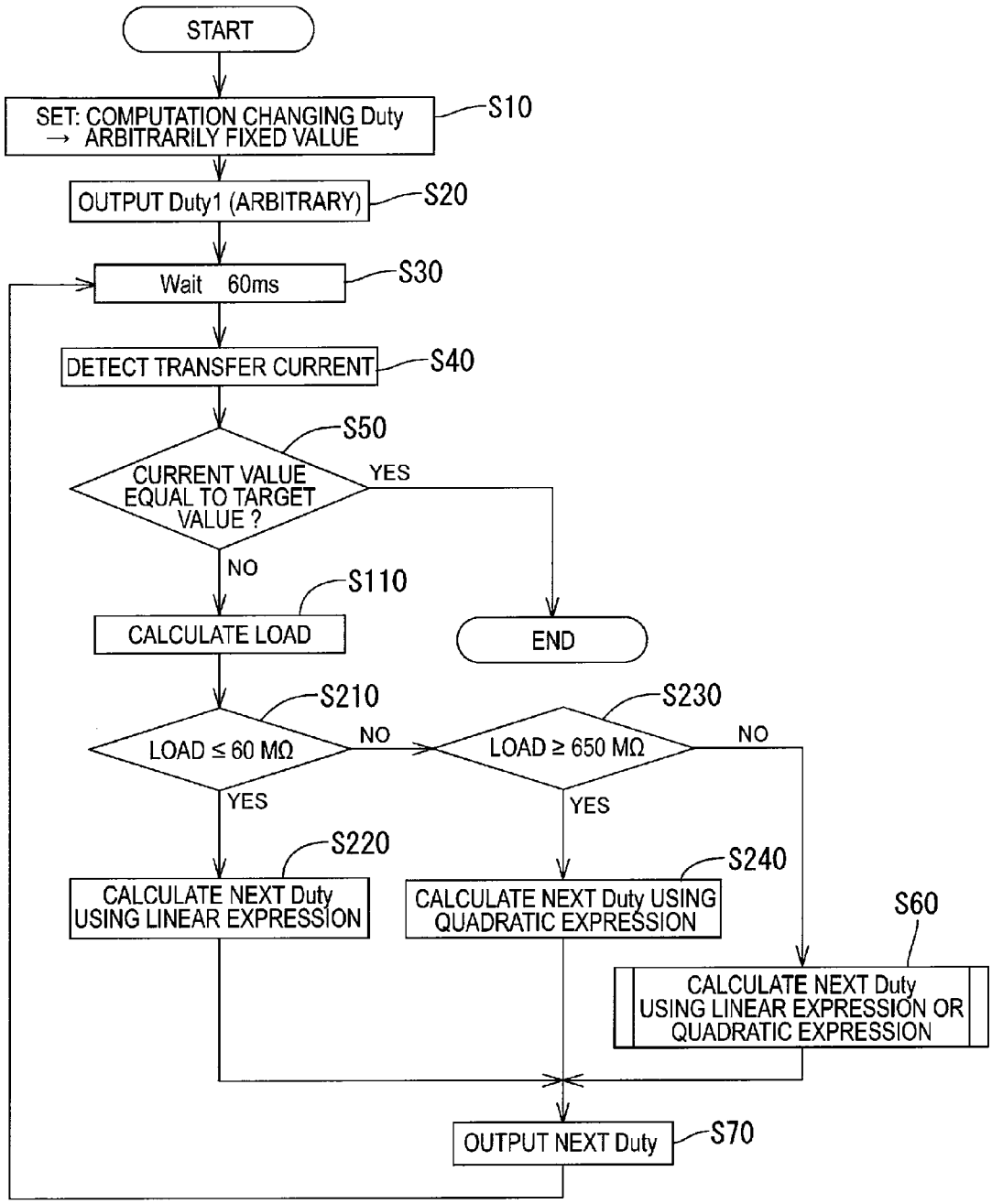
FIG. 12 is a flowchart showing each processing of calculating the duty ratio performed in a third illustrative aspect.

FIG. 12 is a flowchart showing each processing of calculating the duty ratio in the third illustrative aspect. When it is determined in the step S50 shown in FIG. 12 that the present transfer current Ii is not equal to the target transfer current value (I_Target), the control circuit 51, similar to the processing in the second illustrative aspect, calculates the load resistance R based on the above formula 1 in the step S110. Then, the control circuit 51 determines in step S210 whether or not the calculated load resistance R is equal to or less than a value, for example, 60 MΩ.

When the load resistance R is equal to or less than 60 MΩ, the process goes to step S220. In the step S220, the next duty ratio (Duty_Next) is calculated using only a linear expression regardless of the arbitrary duty ratio (Duty1). Note that the processing of the step S220 for calculating the next duty ratio is identical with the processing of the step S620 shown in FIG. 5. Then, the process goes to the step S70, so that the control circuit 51 repeats the processing of the steps from S30 to S70 shown in FIG. 12 until the present transfer current Ii becomes equal to the target transfer current value (I_Target).

On the other hand, when it is determined in the step S210 that the load resistance R is neither equal to nor less than 60 MΩ, it is determined in step S230 whether or not the load resistance R is equal to or greater than a value, for example, 650 MΩ.

When the load resistance is equal to or greater than 650 MΩ, the process goes to step S240. In the step S240, the next duty ratio (Duty_Next) is calculated using only a quadratic expression regardless of the arbitrary duty ratio (Duty1). Note that the processing of the step S240 is identical with the processing of the step S650 shown in FIG. 7. Then, the process goes to the step S70, so that the control circuit 51 similarly repeats the processing of the steps from S30 to S70 until the present transfer current Ii becomes equal to the target transfer current value (I_Target).

On the other hand, when it is determined in the step S230 that the load resistance R is neither equal to nor greater than 650 MΩ, i.e. when the load resistance R is greater than 60 MΩ and less than 650 MΩ, the process goes to the step S60, so that the above-described "next Duty calculating using linear expression or quadratic expression" routine is executed. Then, the process goes to the step S70, so that the control circuit 51 similarly repeats the processing of the steps from S30 to S70 until the present transfer current Ii becomes equal to the target transfer current value (I_Target).

Thus, in the third illustrative aspect, when calculating the duty ratio, the approximate expression to be used is changed according to the load resistance R. That is, when the load resistance is equal to or less than 60 MΩ (a first resistance value), the linear expression is derived regardless of the arbitrary duty ratio (Duty1) (the arbitrary control signal value) and, using the linear expression, the next duty ratio (Duty_Next) is calculated. Furthermore, when the load resistance R is equal to or greater than 650 MΩ (a second resistance value), which is greater than 60 MΩ, the quadratic expression is derived regardless of greatness of the arbitrary duty ratio and, using the quadratic expression, the next duty ratio is calculated. Therefore, in comparison with the process of the first illustrative aspect, the process of calculating the next duty ratio is easier, and the calculating processing time is shortened.

<Other Illustrative Aspects>

The present invention is not limited to the illustrative aspects described above with reference to the drawings. For example, the following illustrative aspects are also included within the scope of the present invention.

(1) In any one of the above illustrative aspects, the duty ratio calculating zone is divided by the computation changing duty ratio illustratively into the linear-expression computing zone and the quadratic-expression computing zone; in the linear-expression computing zone, the relationship between the duty ratio and the transfer current is approximated to the linear expression; in the quadratic-expression computing zone, the relationship is approximated to the quadratic expression. The present invention is not limited to this. For example, it may be configured so that two computation changing duty ratios are provided to divide the duty ratio calculating zone into three zones, and the relationship between the duty ratio and the transfer current is approximated to three kinds of expressions. Furthermore, the approximate expression (relational expression) is not limited to the linear expression and the quadratic expression. For example, a third or higher order approximate expression may be used.

(2) In any one of the above illustrative aspects, the circuit configuration of the applying circuit 60 is illustrated so such that the transfer current It is increased as the duty ratio of the PWM signal is decreased. The present invention is not limited to this. The present invention can be adapted to an applying circuit having a circuit configuration that the transfer current is increased as the duty ratio is increased. In this case, the linear-expression computing zone (the first calculating zone) and the quadratic-expression computing zone (the second calculating zone), which are shown in FIG. 3 and the like, are reversed. Likewise, the relationship between the load resistance R and the computation changing duty ratio shown in FIG. 11 is also reversed.

(3) In any one of the above illustrative aspects, the predetermined control signal value of the first coordinates is illustratively set at the current start-up duty ratio, while the predetermined transfer current value of the first coordinates is illustratively set at "zero". The first coordinates are not limited to this. For example, the transfer current value at the current start-up duty ratio may be set at a value other than "zero". Furthermore, the first coordinates may be other coordinates determined in advance by experiments or the like.

(4) In any one of the above illustrative aspects, the control signal is illustratively the PWM signal, while the control signal value is illustratively the duty ratio of the PWM signal. The present invention is not limited to this. For example, the control signal may be a DC signal, and the control signal value may be a voltage value of the DC signal. In this case, the smoothing circuit is unnecessary.

(5) When calculating the duty ratio, the approximate expression of the second illustrative aspect may be, similar to the third illustrative aspect, changed according to the load resistance R. That is, the processing after the step S210 shown in FIG. 12 may be performed after the step S120 shown in FIG. 10.

What is claimed is:

1. An image forming apparatus comprising:

an image carrier configured to carry a developer image;

a transfer device configured to transfer the developer image to a recording media;

an applying circuit configured to apply transfer bias voltage to the transfer device;

a computation circuit; and a controller;

wherein:

the computation circuit derives a relational expression according to a control signal value calculating zone, representing a relationship between a control signal value supplied to the applying circuit and a transfer current due to applying the transfer bias voltage;

the computation circuit calculates a target control signal value according to the calculating zone and using the derived relational expression, the target control signal value corresponding to a target transfer current value; and the controller controls the applying circuit using the control signal having the target control signal value.

2. The image forming apparatus according to claim 1, wherein:

the calculating zone includes a first calculating zone and a second calculating zone, the first calculating zone and the second calculating zone being divided by a preset control signal value;

when an arbitrary control signal value for deriving the relational expression belongs to the first calculating zone, the computation circuit derives a first relational expression; and when the arbitrary control signal belongs to the second calculating zone, the computation circuit derives the second relational expression.

3. The image forming apparatus according to claim 2, further comprising a current detecting circuit configured to detect the transfer current;

wherein:

the computation circuit derives either one of the first relational expression and the second relational expression using first coordinates and second coordinates, wherein the first coordinates are defined by a predetermined control signal value and a predetermined transfer current value, and the second coordinates are defined by the arbitrary control signal value and a transfer current value that is detected when the transfer bias voltage is applied by the arbitrary control signal value.

4. The image forming apparatus according to claim 3, further comprising a resistance detecting circuit configured to detect load resistance based on the arbitrary control signal value and the detected transfer current value;

wherein:

when calculating the target control signal value, the computation circuit derives the relational expression according to a value of the detected load resistance.

5. The image forming apparatus according to claim 4, wherein:

the preset control signal value is changed according to the load resistance value.

6. The image forming apparatus according to claim 4, wherein:

when the detected load resistance value is equal to or less than a first resistance value, the computation circuit derives the relational expression as a linear expression regardless of the arbitrary control signal value; and when the detected load resistance value is equal to or greater than a second resistance value, and when the second resistance value is greater than the first resistance value, the computation circuit derives the relational expression as a quadratic expression regardless of greatness of the arbitrary control signal.

7. The image forming apparatus according to claim 3, wherein:

the target control signal value is calculated using either one of the first relational expression and the second relational expression;

when one of the target control signal value and the arbitrary control signal value is greater than the preset control signal value, and the other is less than the preset control signal value, the computation circuit derives the other relational expression using the first coordinates and third coordinates, wherein the third coordinates are defined by the preset control signal value and a transfer current value that corresponds to the preset control signal value in the one of the relational expressions; and the computation circuit assigns the target transfer current value to the other relational expression, and thereby re-calculates the target control signal value.

8. The image forming apparatus according to claim 3, wherein:

the predetermined control signal value of the first coordinates is a control signal value that can start up the transfer current; and the transfer current value of the first coordinates is zero.

9. The image forming apparatus according to claim 2, wherein:

the first relational expression is derived as a linear expression; and the second relational expression is derived as a quadratic expression.

10. The image forming apparatus according to claim 9, wherein:

the arbitrary control signal value has a value that belongs to the first calculating zone.

11. The image forming apparatus according to claim 9, wherein:

the arbitrary control signal value has a value that belongs to the second calculating zone.

12. The image forming apparatus according to claim 1, wherein:

the control signal is a PWM signal; and the control signal value is a duty ratio of the PWM signal.

* * * * *